United States Patent [19]

Rosati

[11] 4,416,532

[45] Nov. 22, 1983

[54] LATCHING AND TENSIONING MECHANISM FOR CLOSED-LOOP BELT SUPPORTING CAPSTAN

[75] Inventor: Alfonso A. Rosati, Longmont, Colo.

[73] Assignee: International Business Machines Corporation, Armonk, N.Y.

[21] Appl. No.: 387,720

[22] Filed: Jun. 11, 1982

[51] Int. Cl.[3] ..... G03G 15/00

[52] U.S. Cl. ..... 355/3 BE; 355/16; 474/111

[58] Field of Search ..... 355/3 BE, 3 R, 16, 133; 474/111, 101

[56] References Cited

U.S. PATENT DOCUMENTS

| | | | |
|---|---|---|---|
| 3,606,532 | 9/1971 | Shelfo | 355/16 X |
| 3,646,866 | 3/1972 | Baltazzi et al. | 355/16 X |
| 3,836,245 | 9/1974 | Hastwell et al. | 355/16 X |
| 4,378,154 | 3/1983 | Hoffman | 355/3 BE |

*Primary Examiner*—Richard L. Moses

*Attorney, Agent, or Firm*—Earl C. Hancock

[57] ABSTRACT

The free end of a cantilever-mounted photoconductor belt capstan is rigidly secured to the machine frame by a pivotable mechanism including a slide pin and dog arrangement for cooperating with a receiving block on the machine frame. This same mechanism is arranged to operate a tension applying/relieving shoe against the inner surface of the photoconductor belt. Pivoting of the mechanism to the open position results in an open access to the capstan so that a closed-loop photoconductor belt is easily removed or installed on the capstan.

5 Claims, 6 Drawing Figures

LATCHING AND TENSIONING MECHANISM FOR CLOSED-LOOP BELT SUPPORTING CAPSTAN

BACKGROUND OF THE INVENTION

CROSS-REFERENCE TO RELATED APPLICATION

Application Ser. No. 06/173,590 filed July 30, 1980, now U.S. Pat. No. 4,319,829, for "Noncircular Photoconductor Belt Mounting Apparatus and Method" by D. L. Janeway and P. A. Stevenson, which is assigned to the same assignee as this application, shows a closed-loop, flexible belt supporting frame attached in cantilever relation to the machine base with a pivotable handle for application and release of tension to the belt.

1. Field of the Invention

The present invention relates to apparatus for mounting flexible, closed-loop photoconductor belts in xerographic copiers and the like. More particularly, the present invention relates to apparatus for mounting closed-loop, flexible belts having photoconductor surfaces thereon so that they retain their proper relationship to the various elements associated with the copying process of the machine. Although not necessarily limited thereto, the present invention is particularly useful for relatively compact, low-cost copier/printer configurations.

2. Description of the Prior Art

Flexible, closed-loop belts having a photoconductor surface thereon are employed in various xerographic copier/printer applications. The photoconductor for such copiers requires periodic replacement. The flexible belt configuration is relatively inexpensive to the user as contrasted to copiers using drums with a continuous photoconductor coat thereon since such devices generally required replacement of the entire drum assembly in order to replace the photoconductor. Some prior art devices employ replaceable photoconductor sheets on drums, but such configurations are not popular because of difficulties in proper attachment and alignment of the photoconductor for correct xerographic process operations. Closed-loop belts on drums or capstans are desirable in that the belt is manufactured to a predetermined tolerance and the mechanism arranged to properly locate the belt relative to the other machine components.

One arrangement for supporting a closed-loop flexible photoconductor belt in a manner which avoids the large size required for a mounting drum and thus is especially compatible with compact copier configurations is shown in U.S. patent application Ser. No. 06/173,590 by D. L. Janeway and P. A. Stevenson, now issued as U.S. Pat. No. 4,319,829. Janeway et al. show a belt supporting capstan which is cantilever attached to the main machine frame and which includes a pivotable handle for releasing or engaging a shoe against the inner surface of the belt for applying or releasing tension to that belt. While the Janeway et al. structure allows removal and application of photoconductor belts on the capstan, separate mechanisms are required to control belt tension and secure the free end of the capstan relative to the base machine to ensure its proper alignment relative to the other xerographic processing components. Accordingly, such devices require relatively complex procedures for replacement of photoconductor belts while ensuring intregrity of the mounted belt relative to the machine elements associated with processing of copies.

Prior art devices using flexible belt photoconductors are known wherein tension is applied or released to the inner surface of the closed-loop photoconductor belt. One example is U.S. Pat. No. 3,694,068 by Jordan wherein a manual handle operates a linkage mechanism for applying and releasing tension to the inner surface of such a closed-loop photoconductor belt. However, Jordan does not suggest any simple arrangement for obtaining both belt tension control and free-end securement of the belt-mounting structure.

Especially in the field of compact xerographic copiers, it is important to maintain belt replacement procedures as simple as possible such that the user with relatively little knowledge or training can perform such a task with ease. None of the prior art obtains such a result, but this is provided by the present invention.

DISCLOSURE OF THE INVENTION

The present invention is concerned with a copier that has a flexible belt guide frame that has one end attached in a cantilever fashion to the base of the copier. Such guide frames include a bar movably mounted for applying outwardly directed tension to the inner face of the belt when the belt is positioned over the guide frame. The improvement in accordance with the present invention includes an interlock receiving arrangement on the copier base located in proximity to the end of the guide frame opposite the cantilever fashion attached end. A member which has an arm with interlocking means and an arrangement for moving the belt tensioning bar is mounted to the guide frame opposite end for rotation between first and second positions. In the first position, the base interlock receiver and the arm interlocking means engage for securing the guide frame opposite end to the copier base, while the belt moving means on the arm actuates the bar in a belt-tensioning direction. In the second position, the arm interlocking means is disengaged and the belt moving means causes the bar to release belt tension, the member and mounting arrangement cooperatively interrelating for locating the member clear of the guide frame opposite end to thus accommodate relatively simple belt installation and replacement.

Accordingly, by the present invention, the user follows a simple release and rotation procedure with respect to the belt mounting mechanism and obtains easy access to replace the belt over the capstan while ensuring positive capstan mounting with respect to the copier base once the belt is secured and tensioned in place. The complexity of releasing multiple mechanisms to allow free access for the photoconductor belt replacement is avoided. Further, the copier operation degradation resulting from an unsecured free end of the cantilever-mounted capstan is avoided by securing that free end with a simple motion by the user.

Those having normal skill in the art will readily recognize the foregoing and other objects, features, advantages and applications of the present invention in the light of the following more detailed description of the exemplary preferred embodiment as illustrated in the accompanying drawings.

DETAILED DESCRIPTION OF THE PREFERRED EMBODIMENT

The exemplary preferred embodiment as shown and described in detail hereinafter is presented in the environment of a two-cycle copier of compact configuration. Those having normal skill in the art will readily understand that the present invention is equally adaptable for use in other machine environments.

Figure 1:
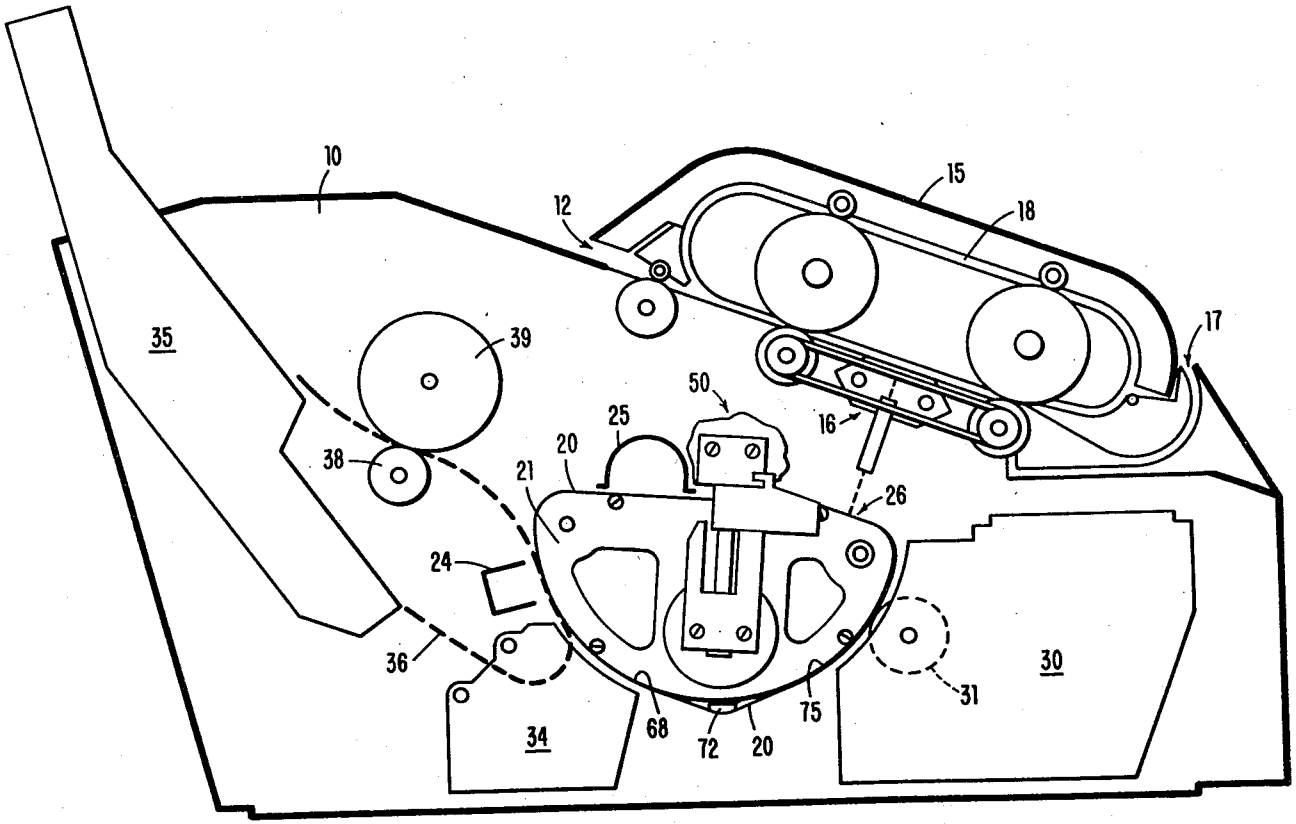
FIG. 1 is a side view of a copier in somewhat schematic form, illustrating the interrelationship of a belt-mount arrangement to the copier elements.

In FIG. 1, copier 10 receives original documents through input slot 12 where they are driven by the document feeder 15 past a fiber optic scanning station 16. The original documents, after processing, are either delivered to the exit slot 17, or are recirculated for multiple copies as by return paper path 18. The image of the original document thus scanned is placed upon a continuous loop photoconductor (PC) belt 20, which is retained in place by means of a capstan or guide frame assembly 21, described in greater detail hereinbelow.

Copier 10 is shown in the two-cycle process configuration wherein coronas 24 and 25 initially operate as precharge and charge coronas, respectively, to place an appropriate electrostatic voltage level on PC belt 20. The image of the original document from fiber optic array 16 is placed upon belt 20 at scan location 26 by selective discharge, based upon the varying levels of light reflected from the original document as is well known. This image is then developed by developer unit 30 which places toner on appropriate areas of belt 20 as it passes the magnetic brush roller 31.

The image on belt 20 encounters paper gating mechanism 34 which controls the introduction of copy sheets from cassette 35 over the paper path shown generally at 36, to the photoconductor belt 20 in appropriate synchronism with the movement of the toned image on belt 20. Corona 24 then operates as a transfer corona to transfer toner from belt 20 onto the copy sheets. The copy sheets continue to the fuser comprised of rollers 38 and 39 where the toner image is fused to the copy sheet substrate. The toned copy sheet is then exited from the machine.

Figure 2:
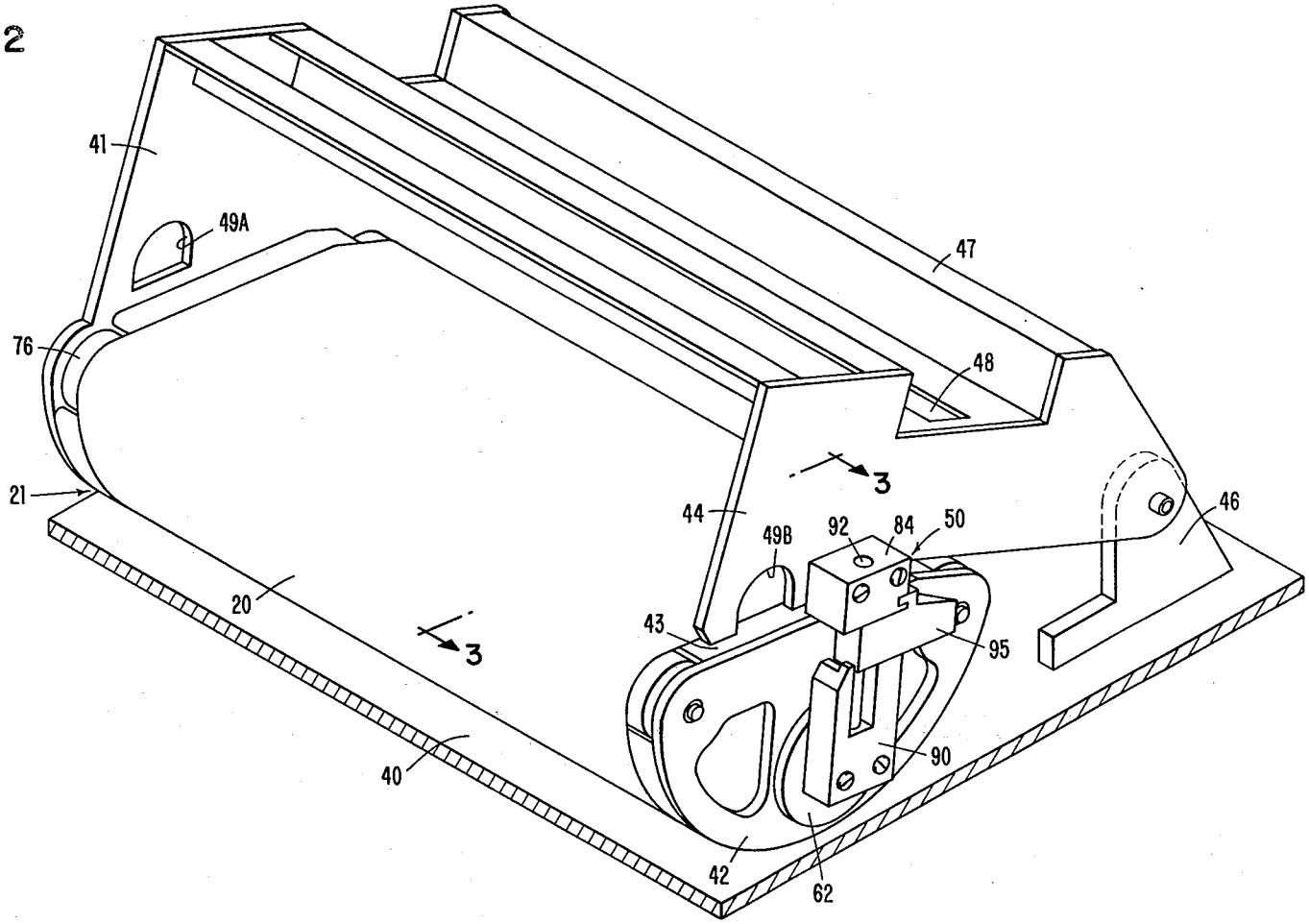
FIG. 2 is an isometric end view of a belt-mounting guide for the FIG. 1 embodiment showing a latching configuration in accordance with this invention.

The mounting of the belt guide frame 21 relative to the main frame 40 of copier 10 is shown in somewhat greater detail in isometric view in FIG. 2. Although not shown in FIG. 2, the machine frame is appropriately configured for appropriate attachment and interfacing between belt guide 21 and other xerographic processing elements such as corona 24, developer 30 and paper feed mechanism 34 shown in FIG. 1. One end of frame 21 is secured to plate 41 while the other end 42 is shown detached from end plate 44 with a gap 43 between plates 42 and 44. Frame 21 is thus mounted in a cantilever relation from end plate 41. Plate 42 is releasably secured relative to end plate 44 by latching assembly 50 in accordance with this invention. As is apparent from the subsequent description, the latching mechanism 50 allows relatively easy replacement of sleeve belt 20 on frame 21 while concurrently applying/releasing tension on belt 20. Prior art devices employ a belt tension release mechanism separate from the frame latch mechanism to allow belt 20 replacement. For instance, it is known to use a separate hook bar attached between plates 42 and 44 which hook is pivotable out of the way of slot 43 between plates 42 and 44.

Cross-member 47 includes a slot 48 to accommodate the fiber optic bundle of scanning assembly 16, not shown in FIG. 2. Plates 41 and 44 are pivotally attached to respective mounting brackets 45 (not shown) and 46 which are, in turn, secured to machine frame 40. Thus the entire assembly, including belt 20 and belt mounting guide 21, is pivotable relative to main frame 40 to allow access for servicing. Holes 49 in plates 41 and 44 accommodate positioning of corona 25, also not shown in FIG. 2.

Roller 58 (note FIG. 3) is driven by a motor (not shown) to impart motivating power to photoconductor belt 20, which is formed as a continuous sleeve, thereby driving belt 20 past the appropriate processing stations. Belt 20 is positively located on roller 58 and thus on frame 21 by including radially extending pins (not shown) near the outer ends of roller 58. These pins are fixed although inclusion of a mechanism for camming the pins in radial directions relative to roller 58 in and out of sprocket type engagement with matching holes on the edge or edges of belt 20 facilitates removal and replacement of sleeve belt 20. Omission of sprocket pins or the like for belt 20 is possible if appropriate synchronization is otherwise included as by edge sensing or by some other means in the copier for synchronizing the movement of original document images of belt 20 with the movement of copy sheets for image transfer purposes.

Figure 3:
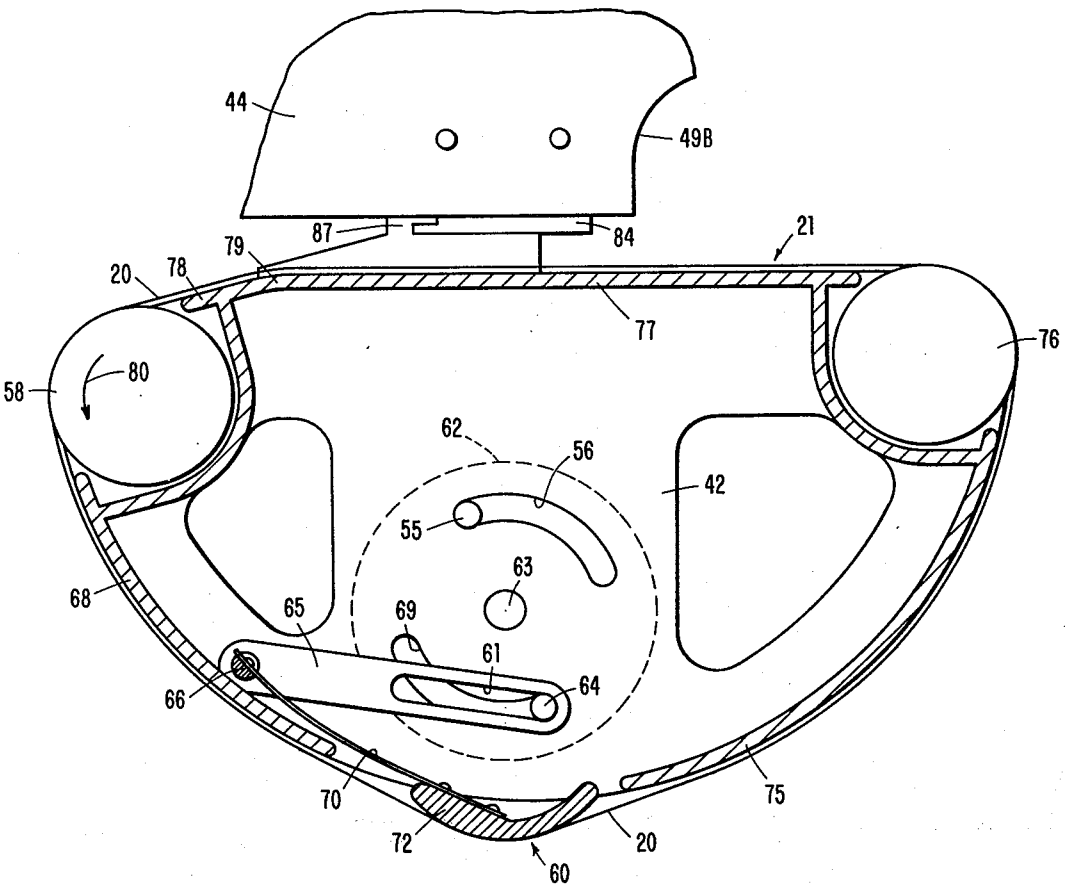
FIG. 3 is sectioned view of the belt mounting apparatus illustrating the interrelationship of the present invention with a belt tension applying/relieving structure.

FIG. 3 presents a sectioned interior view of belt mounting guide 21, particularly illustrating the interrelationship of the components including the tensioning assembly 60. Rotary hub 62 shown in FIG. 2, is mounted for rotary movement around a shaft or stub 63 in end frame 42. Pin 55 extends inwardly from hub 62 through guide slot 56 while pin 64 extends inwardly through slot 69 into capstan guide 21 so as to engage the interior groove 61 in bar 65. Bar 65 is further attached to shaft 66, which is retained in hole 67 in end frame 42 visible in FIG. 4.

Rotation of latch assembly 50 as later described, causes member 62 to rotate in a clockwise direction as viewed in FIG. 3 (counterclockwise as viewed in FIGS. 2 and 4). This causes pin 64 to rotate through roughly 90°. In the position shown in FIG. 3, cantilever spring member 70 holds curved plate or shoe 72 in an outward direction, thereby applying slack-removing tension to the interior surface of belt 20. To accommodate removal and replacement of sleeve-type photoconductor belt 20, rotation of pin 64 by 90° clockwise from the position shown in FIG. 3 causes yoke bar 65 and therefore shaft 66 to rotate counterclockwise so that spring arm 70 pivots upwardly into the interior of frame guide 21, thereby withdrawing shoe 72 into frame 21 while loosening belt 20 for easy movement over the surface of guide 21.

Note that belt guide 21 is essentially formed of a series of interconnected courses. That is, member 21 is formed such as by extrusion or the like, with surfaces defined by sidewalls 68 and 75 essentially defining two segments of a path configured to appropriately interface with elements such as developer/cleaner 30 and sheet feed mechanism 34 shown in FIG. 1. The presence of transition courses on either side of side walls 68 and 75 results in a predictably reliable interface relation between moving belt 20 and the relatively fixed processing elements.

The belt guiding courses defined by guide 21 include an idler roller 76 acting as an interface between surface 75 and a flat guide portion 77. A second essentially straight or flat portion 78 is positioned relative to the imaging area, and a bend 79 is formed at the transition between surfaces 77 and 78. Drive roller 58 completes the belt guiding courses of the closed loop. Note that, for purposes of illustration, belt 20 is shown slightly separated from the surfaces of guide 21. In actual practice, belt 20 generally contacts and conforms to various external surfaces of guide 21. Further, bend 79, as well as idler roller 76 and tensioning shoe plate 72, tend to apply a certain amount of drag to belt 20 as it is driven by roller 58 in the direction generally suggested by arrow 80. Thus, belt 20 is assured of a relatively flat configuration as it passes the scanning area over flat surface 78.

Any of a wide variety of apparatus and techniques are available as alternatives for the elements shown. For instance, air bearings are adaptable for surfaces such as on tensioner bar 72 and rollers 58 or 76. It is also possible to use other belt tensioning mechanisms than spring arm 70. Rollers or the like can engage the interior surface of closed-loop belt 20 in place of the friction surface of shoe element 72. Air pressure or a vacuum engagement can also selectively apply tension to belt 20.

Figure 4:
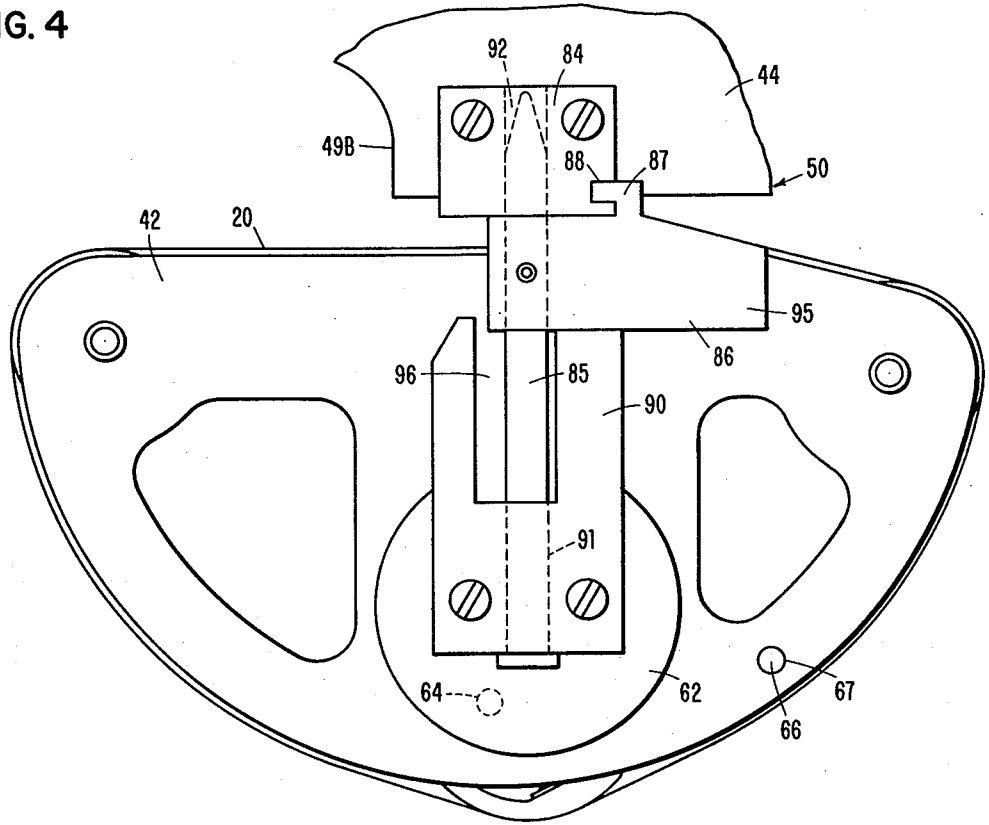
FIG. 4 is a partially broken, expanded view of the latch assembly 550 in its closed and interlocked position.
Figure 6:
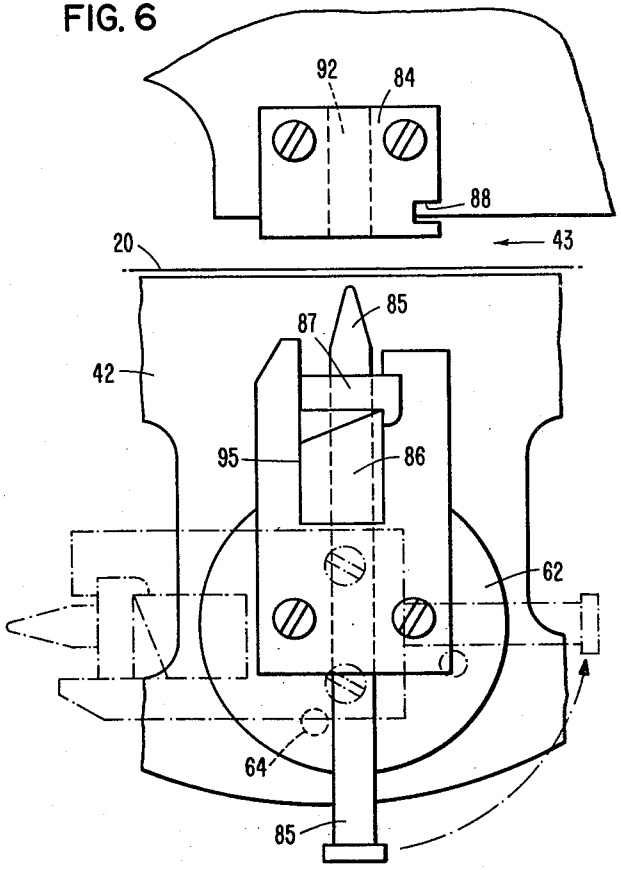
FIGS. 5 and 6 show the sequential positions assumed by the latch elements when it is released for replacing-/installing a photoconductor belt on capstan 21.
Figure 5:
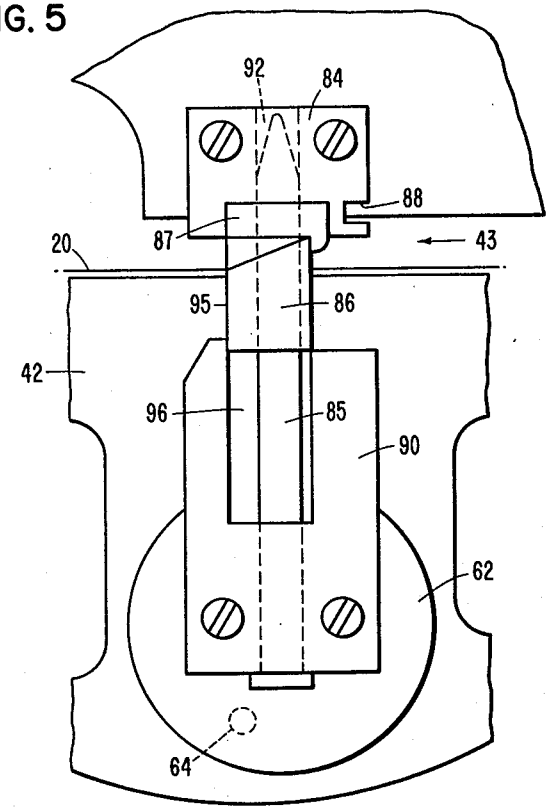

FIGS. 4, 5 and 6 generally illustrate the operating interrelationship of the latching assembly 50. Although only a portion of plate 44 is shown in FIG. 4, this element is shown in greater detail in FIG. 2. Block 84 is secured in fixed relation to plate 44. Lever 86 is attached to shaft 85 and has an inverter "L" shaped shoulder 87 to engage and interlock with the similarly shaped receiving channel 88 in block 84.

Yoke 90 has a bore 91 therethrough for slidably retaining the lower end of shaft 85 while bore 92 in block 84 similarly retains the upper end of shaft 85. In the FIG. 4 position, pin 85 along with L-shaped interlocking shoulder 87 engage bores 91 and 92 and interlock receiving slot 88, respectively, so that plate 42 and thus the free end of guide frame 21 is reliably secured in fixed relation to end plate 44 thereby ensuring that belt 20 is properly positioned relative to the other copier components for xerographic processing.

By grasping outer end 95 of lever 86 and pivoting it 90° upwardly from the FIG. 4 position to the FIG. 5 position, lever 86 assumes the position of FIG. 5 with shoulder 87 clear of groove 88. Note that the width of lever 86 is such as to fit into channel 96 of yoke 90. Thus sliding of lever 86 downwardly results in withdrawal of shaft 85 from bore 92 of block 84 thereby producing the solid line position of FIG. 6. This releases plate 42 from plate 44 and opens gap 43 to permit easy sliding movement of belt 20 over capstan 21 once tension is released from belt 20. Belt tension release is accomplished by pivoting lever 86 and thus yoke 90 by 90° counterclockwise into the horizontal position shown in phantom in FIG. 6. Since hub element 62 is attached to yoke 90, rotary motion of yoke 90 directly controls the belt 20 tension applying/releasing operation as described above for FIG. 3.

In use, a belt 20 is installed by pivoting lever 86 and thus hub 62 so as to ensure that curved shoe 72 is withdrawn into frame 21 with slot 43 unobstructed. A sleeve-type photoconductive belt 20 is then passed through slot 43 onto frame 21 into the position generally shown in FIGS. 2, 3 and 4. Lever 86 is then pivoted in the opposite direction so that shoe 72 applies pressure to the interior surface of belt 20 as shown in FIG. 3 to place belt 20 into a state of tensile stress. Lever 86 is raised forcing locator shaft 85 upward into bore 92 of block 84. Lever 86 is pivoted to engage shoulder 87 into groove 88. The free end of capstan frame 21 is then securely interlocked relative to the other xerographic elements. Note that the lower end of shaft 85 is shouldered to retain it in bore 91 when the latch mechanism is released.

The tensioning apparatus 60 is arranged such that the belt 20 is in conformity to a segment of the periphery of a drum as it interfaces with the other xerographic processing elements such as 30 and 34 in FIG. 1. The fixed positions of side walls 68 and 75 with respect to the curved interfaces of elements 24, 30 and 34 ensures that belt 20 is maintained in proper relation to these elements as it moves, thereby realizing an advantage not enjoyed by rotating drums unless precision parts and manufacturing techniques are used. Belt 20 cooperates with the processing stations in a conventional manner after placement on guide 21.

Although the present invention is described herein with particularity relative to the foregoing detailed description of an exemplary preferred embodiment, various modifications, changes, additions, and applications of the present invention in addition to those mentioned herein will readily suggest themselves to those having normal skill in the art without departing from the spirit of this invention.

What is claimed is:

1. In a copier having a flexible belt guide frame attached at one end in cantilever fashion to the copier base with said guide frame including a bar movably mounted for applying outwardly directed tension to the inner face of the belt when the belt is positioned over said guide frame, an improvement comprising:

interlock receiving means on said copier base located in proximity to the end of said guide frame opposite said cantilever fashion attached end, a member having an arm with interlocking means and means for moving said belt tensioning bar thereon, and means mounting said member to said guide frame opposite end for rotation between (i) a first position wherein said base interlock receiving means and said arm interlocking means engage for securing said guide frame opposite end to said copier base while said belt moving means of said arm actuates said bar in a belt-tensioning direction, and (ii) a second position wherein said arm interlocking means is disengaged and said belt moving means causes said bar to release belt tension, said member and said mounting means being cooperatively interrelated for locating said member clear of said guide frame opposite end when in said second position.

2. In a copier having a guide frame for supporting a closed-loop, flexible belt wherein said guide frame is attached at one end in cantilever fashion to the copier base and a plate at least partially encloses the opposite end of said frame with said guide frame having internally therein a shoe attached to a spring arm and means connected to said spring arm for moving said shoe between a first position wherein said shoe applies outwardly directed tensioning force to the inner face of the belt and a second position wherein said shoe is withdrawing into said guide frame, an improvement comprising:

a block rotatably attached to said opposite end plate, a latch assembly attached to said block and including first interlocking means, receiving means attached to said copier base and including a second interlocking means, means mounting said latch assembly and said receivng means for relative movement of said interlocking means between an engaged position wherein said guide frame opposite end is secured to said machine base and a disengaged position wherein said guide frame opposite end is open for allowing movement of said belt over said opposite end plate, and means coupling said block to said spring arm moving means for moving said shoe into said first and second positions when said interlocking means are respectively in said engaged and disengaged positions.

3. An improved copier in accordance with claim 2 wherein said block includes a channel radially oriented relative to said block rotation, said latch assembly includes a shaft slidably retained in said channel, and said receiving means includes a groove for receiving one end of said shaft for establishing said interlocking means engaged position.

4. An improved copier in accordance with claim 3 wherein said latch assembly includes a handle attached to said shaft with said handle pivotable around said shaft between a first position for retaining said shaft in said engaged position and a second position for allowing said shaft to slide in said block channel into said disengaged position.

5. An improved copier in accordance with claim 4 wherein said handle and said receiving means include tongue and groove means for securing said handle to said receiving means when in said engaged position.

* * * * *